US011700957B2

(12) United States Patent
Tegel

(10) Patent No.: US 11,700,957 B2
(45) Date of Patent: Jul. 18, 2023

(54) SPECTACLE FRAME SECURING DEVICE AND METHOD FOR ASSEMBLY OF A DISPLAY UNIT OF A SPECTACLE FRAME SECURING DEVICE

(71) Applicant: Top Vision Group, Haarlem (NL)

(72) Inventor: Omar Tegel, Haarlem (NL)

(73) Assignee: Top Vision Group, Haarlem (NL)

( * ) Notice: Subject to any disclaimer, the term of this patent is extended or adjusted under 35 U.S.C. 154(b) by 15 days.

(21) Appl. No.: 17/439,711

(22) PCT Filed: Mar. 16, 2020

(86) PCT No.: PCT/NL2020/050175

§ 371 (c)(1),
(2) Date: Sep. 15, 2021

(87) PCT Pub. No.: WO2020/218919

PCT Pub. Date: Oct. 29, 2020

(65) Prior Publication Data

US 2022/0160148 A1 May 26, 2022

(30) Foreign Application Priority Data

Mar. 15, 2019 (NL) ..... 2022751

(51) Int. Cl.
*A47F 7/024* (2006.01)

(52) U.S. Cl.
CPC ..... *A47F 7/0243* (2013.01)

(58) Field of Classification Search
CPC ..... A47F 7/0243; A47F 7/024; A47F 7/1021; A47F 7/02; E05B 73/00; E05B 73/0035
USPC ..... 211/85.1, 8; 248/902; 206/5
See application file for complete search history.

(56) References Cited

U.S. PATENT DOCUMENTS 4,805,781 A * 2/1989 Tegel ..... A47F 7/0243 211/8
6,073,781 A * 6/2000 Puglisi ..... B25H 3/04 211/60.1
6,182,840 B1 * 2/2001 Tegel ..... A47F 7/0243 211/85.1

(Continued)

FOREIGN PATENT DOCUMENTS

CA 2425017 A1 * 10/2004 ..... A47F 7/0243
CA 2620445 C * 4/2012 ..... A47F 7/0243
CN 114206168 A * 3/2022 ..... A47F 7/0243
DE 102006034876 A1 * 1/2008 ..... A47F 7/0243
DE 102007036602 A1 * 2/2009 ..... A47F 7/0243

(Continued)

*Primary Examiner* — Jennifer E. Novosad
(74) *Attorney, Agent, or Firm* — The Webb Law Firm

(57) ABSTRACT

A spectacle frame securing device for securely displaying of a product, such as a spectacle frame or glasses, relative to a display board with a display surface includes at least one display unit including a frame or chassis for arranging thereof relative to the display surface, a product holder for holding of the product during displaying thereof, and a lock-in assembly. The lock-in assembly includes a lock-in member movable between an opened position and a closed position, for locking in of the product in the holder when the lock-in member is in the locked position and transfer means for transferring of a movement to the lock-in member from drive means for the purpose of moving between the opened position and the closed position. Each of the at least one display unit is separately arrangeable relative to the display surface arrangeable of the display board.

22 Claims, 15 Drawing Sheets

(56) References Cited

U.S. PATENT DOCUMENTS

| | | | | | |
|---|---|---|---|---|---|
| 6,364,124 | B1 * | 4/2002 | Chen | A47F 7/0243 | 211/85.1 |
| 7,134,559 | B2 * | 11/2006 | Zoueki | A47F 7/0243 | 211/85.1 |
| 7,270,241 | B2 * | 9/2007 | Nobili | A47F 7/0243 | 211/85.1 |
| 8,307,999 | B2 * | 11/2012 | Pintur | A47F 7/0243 | 211/8 |
| 8,646,619 | B2 * | 2/2014 | Winig | A47F 7/0243 | 70/57.1 |
| 8,646,623 | B2 * | 2/2014 | Winig | A47F 7/0243 | 70/57.1 |
| 10,314,414 | B2 * | 6/2019 | Tegel | E05B 73/00 | |
| 10,485,362 | B2 * | 11/2019 | Pintur | A47F 7/021 | |
| 2022/0160148 | A1 * | 5/2022 | Tegel | A47F 7/0243 | |

FOREIGN PATENT DOCUMENTS

| | | | | | |
|---|---|---|---|---|---|
| DE | 102008054023 | A1 * | 5/2010 | A47F 7/0243 | |
| DE | 102010022422 | A1 * | 12/2011 | A47F 7/0243 | |
| DE | 102013105156 | A1 * | 3/2014 | A47F 7/0243 | |
| DE | 102019126681 | A1 * | 4/2021 | | |
| EP | 1582118 | A1 * | 10/2005 | A47F 7/0243 | |
| EP | 1582118 | A1 | 10/2005 | | |
| EP | 2392235 | A1 * | 12/2011 | A47F 7/0243 | |
| EP | 2611338 | A2 | 7/2013 | | |
| EP | 3453289 | A1 | 3/2019 | | |
| EP | 3453289 | A1 * | 3/2019 | A47B 96/021 | |
| EP | 2611338 | B1 * | 3/2020 | A47F 7/021 | |
| FR | 2830732 | A1 * | 4/2003 | A47F 7/0243 | |
| WO | 2012050435 | A2 | 4/2012 | | |
| WO | 2015047087 | A2 | 4/2015 | | |
| WO | WO-2015047087 | A2 * | 4/2015 | A47F 5/08 | |
| WO | WO-2020218919 | A1 * | 10/2020 | A47F 7/0243 | |

* cited by examiner

SPECTACLE FRAME SECURING DEVICE AND METHOD FOR ASSEMBLY OF A DISPLAY UNIT OF A SPECTACLE FRAME SECURING DEVICE

CROSS-REFERENCE TO RELATED APPLICATIONS

This application is the United States national phase of International Application No. PCT/NL2020/050175 filed Mar. 16, 2020, and claims priority to The Netherlands Patent Application No. 2022751 filed Mar. 15, 2019, the disclosures of which are hereby incorporated by reference in their entirety.

BACKGROUND OF THE INVENTION

Field of the Invention

The present invention relates to a spectacle frame securing device for securely displaying of a product, such as a spectacle frame or glasses, relative to a display board with a display surface, such as a counter, shelf, (cabinet-) board or display wall, doing displaying thereof and releasing thereof for the purpose of handling by a person. Furthermore, the present invention relates to a method for manufacturing of a display unit of such a spectacle frame securing device.

Description of Related Art

For the purpose of displaying spectacles, it is known to use a display column with a number of display positions arranged therein above each other in the column. In this practice, it is therefore possible to realize a high density of display positions that are secured in the column and per wall with a number of columns.

In certain segments of the industry, a display facility on a shelf or tabletop exists. In order to be able to provide securing of the spectacles also in that setting, the present invention provides a spectacle frame securing device for securely displaying of a product, such as a spectacle frame or glasses, relative to a display board with a display surface, such as a counter, shelf, (cabinet-) board or display wall, doing displaying thereof and releasing thereof for the purpose of handling by a person, the device comprising:

- at least one display unit comprising:
  - a frame or chassis for arranging thereof relative to the display surface,
  - a product holder for holding of the product during displaying thereof,
  - a lock-in assembly, the lock-in assembly comprising a lock-in member movable between an opened position and a closed position, for locking in of the product in the holder when the lock-in member is in the locked position,
  - transfer means for transferring of a movement to the lock-in member from drive means for the purpose of moving between the opened position and the closed position,
- wherein each of the at least one display unit is separately arrangeable relative to the display surface arrangeable of the display board.

SUMMARY OF THE INVENTION

With this, the present invention advantageously provides a securing when displaying a spectacle frame on a surface.

With this, it is advantageously envisioned that the surface is substantially arranged horizontally, but an oblique setting is to be interpreted as included. An advantage of the present invention is that it becomes possible according to preferred embodiments to arrange the spectacle frame or spectacle frames readily in the display unit in a manner that the bridge of the spectacle frame is supported by the product holder or in a manner that the spectacle frame is supported on the display surface while the bridge of the spectacle frame is arranged such that it is locked in by the lock-in member.

A further advantage of such a spectacle frame securing device is that it is arrangeable at a display board of many materials and thicknesses. Such a spectacle frame securing device is suitable for arranging at a glasses board in preferred embodiments for which the display unit is fully arrangeable on the display surface, preferably including drive means. Furthermore, a spectacle frame securing device according to the present invention is suitable for a display board of mood or metal or an artificial material. The thickness of the display board may be advantageously be from several millimeters to several centimeters.

According to a first preferred embodiment, the display unit comprises the drive means embodied as frame drive means, such as comprising a drive motor, such as a stepper motor, for driving of the lock-in member by means of the transfer means between the opened position and the closed position. With this, it is advantageously realized that the display unit is autonomously capable of transferring the lock-in member between the opened and the closed position, that is without drive means external to the display unit. As opposed to the preferred embodiments described below, no drive means are required from the other side of the display surface. A further advantage of application of such stepper motor is the drive precision, correct functioning with a needed current and/or small-diameter independent of the load.

According to a further preferred embodiment, the frame drive means fastened to the frame form an intermediate product as basis for assembly of the spectacle frame securing device. With this, it is advantageously realized that the mutual arrangement of the frame drive means and the frame is determined during prefabrication. Furthermore, the number of operations during assembly and storage control is advantageously limited. Furthermore, it is advantageously realized that the combination of a compact stepper motor as assembled in the frame requires limited dimensions at the location of the motor. Furthermore, it is advantageously realized that the motor may be positioned and fastened to the frame during prefabrication in a precise manner such that it is positionable and fastenable to the frame in such a manner that a connector of the motor is directly coupleable with a corresponding connector on a PCB comprising a control.

According to a further preferred embodiment, the display unit comprises a housing enclosing the frame and the shut-in assembly, and/or wherein the housing encloses a part of the product holder or forms the product holder, further preferably wherein the housing comprises a base for arranging against the display surface. With application of such a housing, it is advantageously realized that the appearance of the display unit may be determined independently from the frame or lock-in assembly. Furthermore, such a housing protects the parts of especially the lock-in assembly from manipulation thereof.

According to a further preferred embodiment, of the spectacle frame securing device, the display unit is preferably mountable to the display board by means of fastening means that extend between the display unit or the frame thereof and the other side, such as the underside or rear side of the display board. With this, a correct arrangement and/or a for mounting of the display unit may be realized.

Further preferably, the spectacle frame securing device comprises a control device, such as comprising a PCB comprising a processing unit and a memory comprising a program, for the purpose of controlling of the drive means, and/or comprising identification means for identification of a specific display unit or a number thereof. By means of such control unit, moving the lock-in member between the opened and closed position may be actuated. The identification means and able specific control per display unit or number of display units.

Further preferably, the PCB with the frame, the product holder and the lock-in assembly are arrangeable to the display surface of the display board as a unit or an assembly, and/or wherein these, preferably via the PCB, comprise contact means, such as a block contact or a, preferably resiliently embodied, pressure contact for connecting with a counter contact from the other side of the display board. Alternatively, a resilient contact is provided between the power supply of the motor of the display unit and the power supply from the display surface, such as embodied as a so-called Pogo pin. By means of such variance of contact, an advantageous coupling with an external power supply and/or control unit may be realized. Alternatively, it is provided that the motor is directly connectable with an underside of the display board, such as by means of a wire connection. With such an embodiment, a control unit as indicated in the above is provided at the underside of such a display board, for each display unit separately or for a number of display units together. Alternatively, a control unit or a combined control unit for a number of display units are provided for a number of display units combines behind a wall, in a cabinet or under the display board, such as with a table or buffet.

According to a further preferred embodiment, the spectacle frame securing device comprises a direct plug-in contact between the PCB and the drive motor. With this, both manufacturing of these parts and assembly of the display unit is advantageously realizable. With the manufacturing of the parts, the plug-in contact is advantageously mountable to the PCB, wherein the assembly by means of plugging in for making the contact is straightforward because contact is made with correct placement of the PCB on the device.

According to a further preferred embodiment, the product holder comprises a, preferably metal, that is fastened or fastenable to the frame. Such a bracket is advantageously manufacturable with a desirable design, such as with a with fitting between the glass of the spectacles under the bridge, with a sufficient firmness as anti-theft security. Preferably, the product holder is provided with means, such as a click in slot, for arranging thereon of a cover unit, such as a front side unit, such as a front unit for the purpose of adapting to a styling of a display environment, such as the house style of a shop.

Further preferably, the lock-in member is a pin or bar that is movable in parallel to the display surface. With this, in the open state of the lock-in member, an opening is created at the top side for straightforward placement of the spectacle frame on the above the product holder. In case of a narrow product holder, merely a small part of the spectacle frame, merely a part of the breach thereof is obstructed from viewing by the product holder.

According to a further preferred embodiment, the transfer means comprising axle with a thread or a tooth rack. With this, a transmission between a rotating motor and a longitudinal movement is realizable in an advantageous manner, especially within the dimensions of a display unit corresponding to a frame or spectacle frame.

According to a further preferred embodiment, the drive motor drives the axle with thread, the axle with red being substantially arranged in parallel to the lock-in member, comprising a propulsion member connected to the pin and comprising a through opening provided with a thread for cooperating with the axle with thread, further preferably comprising a guiding pin for guiding of the propulsion member at preferably another side of the axle with thread relative to the lock-in member. By means of these variants, a reliable and/or robust driving of the propulsion member is realized in an advantageous manner.

Further preferably, the spectacle frame securing device comprises at least one sensor, such as a positioning sensor or, such as a switching sensor for receiving of the position of the lock-in member relative to the center, wherein the sensor is preferably connected to the processing unit and/or arranged at the PCB. With this, a position of the locking member is advantageously determined. In an advantageous manner, with a thereto suitable arrangement of 2 sensors, and opened state and a closed state is determined.

According to a further preferred embodiment, the locking member is a movable, preferably around an axle of rotation, arched pin or bar, further preferably driven by means of a curved tooth rack. With this, another spatial configuration of the lock-in member is realized.

According to a further preferred embodiment, the locking member comprises a hingeable or tiltable hook element. Also with this, another spatial configuration of the lock-in member is realized.

According to a further preferred embodiment, the spectacle frame securing device comprises an electrical connection from the display unit for coupling with a spectacle frame securing control for provision of a control signal for the control unit for movement of the lock-in member between the opened and the closed position from the spectacle frame control, preferably for provision of a spectacle frame securing control from an electricity supply for the display unit. By means of such a spectacle frame securing control, it is advantageously realized that the lock-in member is controllable from this spectacle frame securing control. The spectacle frame securing control is for example controllable by the user by means of a remote control or based on infrared or RF or by means of a control application on a mobile device, such as a phone or tablet, by means of fixed control buttons in the display space or similar.

Further preferably, the electrical connection is embodied as a PCB, cable loom or cable or by means of a contactless connection.

A further preferred embodiment according to the invention relates to a spectacle frame securing device comprising connecting means for connecting of the lock-in assembly with the drive means embodied as a board drive assembly that is arranged at the other side of the display surface of the display board via an opening, such as a slot, in the display board, which opening is further preferably covered by the display unit.

Such an embodiment provides in an advantageous manner the possibility of a manual drive with a key lock such as are generally used with a spectacle frame display column according to the prior art. Such a locking system is commonly used and it is advantageous when with use of already used keys of blocks, the spectacle frame securing according to the present invention can be added. Furthermore, it is advantageous when an embodiment for use with a lock can be used in a cabinet or at a wall without wiring present for providing of a control or electrical power.

Further preferably, the drive means are herein embodied as the board drive means, the board drive means comprising board transfer means, preferably comprising a control track for providing of a transverse transmission, for transmission of a driving movement by hand force or motor force to the connecting means, preferably comprising a number of coupling means for coupling with a respective number of display units, the number of transmission means comprising connecting means for mutually connecting of the number of board transfer means, the number corresponding with a corresponding number of display units. Such a board drive assembly is arranged under or in the board, preferably under or invisible relative to the display surface. With this, a drive is provided that makes the lock-in member movable between the opened and closed state.

For the purpose of providing of motion energy, further preferably a lock secured hand actuator or motor actuator comprising a motor, such as a DC motor or server motor, is hereto provided, and a control unit, such as comprising a PCB, comprising a processing unit and a memory comprising a program, for the purpose of controlling the drive means, further preferably provided with identification means for identifying a specific display unit or a number thereof.

For the purpose of using a light module for lighting of an underlying display surface and thereon displayed spectacle frames, the spectacle frame securing device comprises passage means for drivingly passing of a lighting module, such as an elongated lighting module or comprising such a lighting module, preferably arranged at the underside of the display board. With this, both a securing and a desirable realizable lighting is advantageously realized.

Further preferably, the frame is embodied as the housing, or the frame and the housing are embodied as a whole.

A further aspect according to the present invention relates to a method for assembly of a display unit of a spectacle frame securing device according to one or more of the preceding claims, comprising steps of:

providing of a frame and a drive motor, providing of the product holder, assembling thereof to an assembled display unit, wherein the frame and the drive motor are provided as a prefabricated intermediate product.

An advantage of such a method according to the present invention is that with this, it is advantageously realized that the mutual arrangement of the frame drive means and the frame is determined during prefabrication thereof. Furthermore, according to such a method, the number of operations during assembly and stock control is advantageously limited. Furthermore, according to such a method, it is advantageously realized that the combination of a compact stepper motor as assembled in the frame at the location of the motor requires small dimensions. Furthermore, according to such a method, it is advantageously realized that the motor, during prefabrication, is precisely positionable and fastenable to the frame such that a connector provided at the motor is directly coupleable with a corresponding connector on a PCB comprising a control.

According to a preferred embodiment according to the present aspect, the provision of a connector contact in the prefabricated intermediate product is in a predetermined orientation for contacting a PCB contact, the method comprising the steps of positioning of the frame relative to the PCB and making the contact there with between the connector contact of the motor and the PCB contact.

BRIEF DESCRIPTION OF THE DRAWINGS

Further advantages, features and details of the present invention will be further elucidated on the basis of a description of one or more preferred embodiments with reference to the accompanying figures. Similar yet not necessarily identical parts of different preferred embodiments may be indicated with the same reference numerals.

DESCRIPTION OF THE INVENTION

Figure 1A:
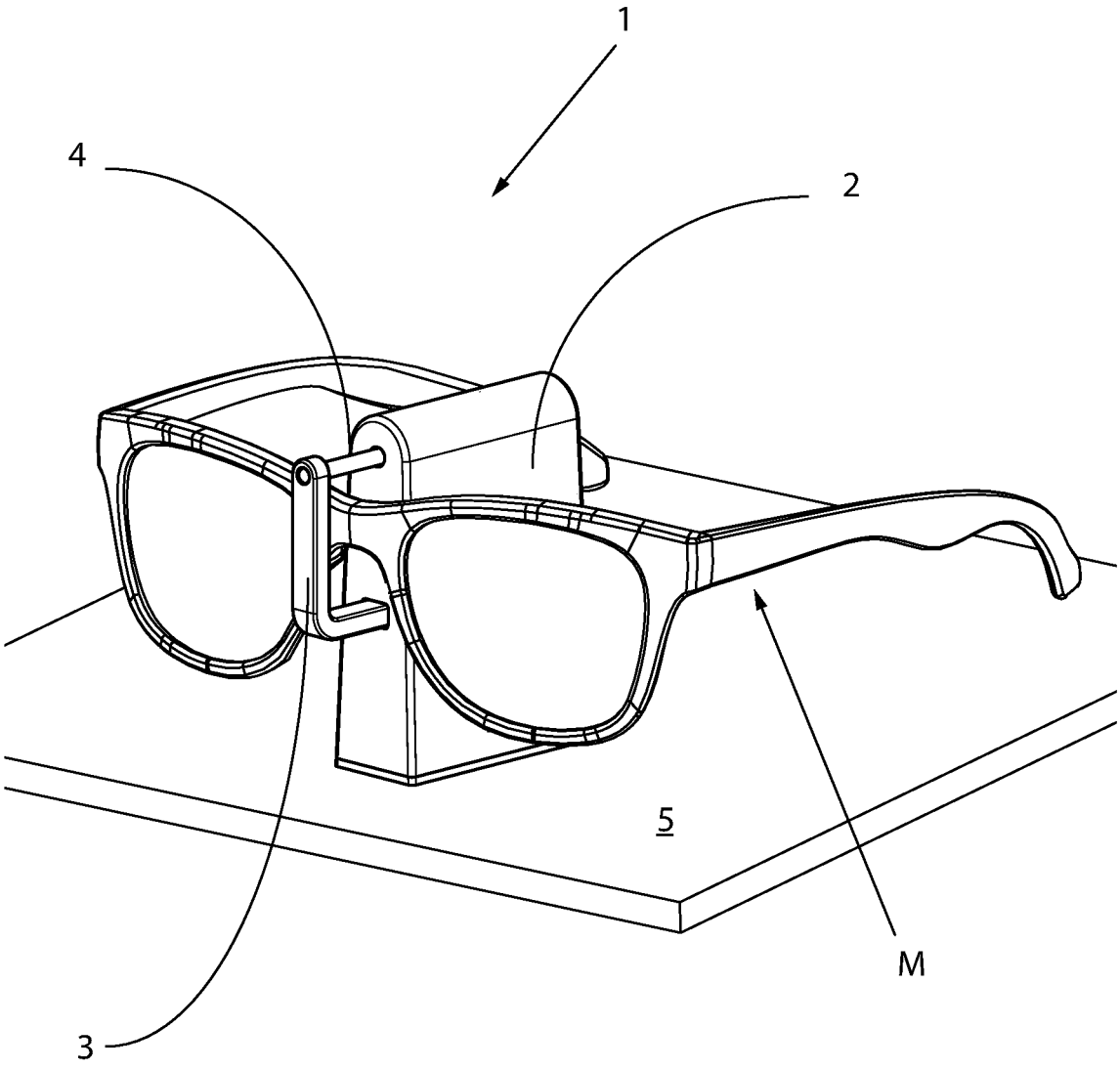
FIGS. 1A-C relates to three views of a first preferred embodiment according to the present invention.
Figure 1B:
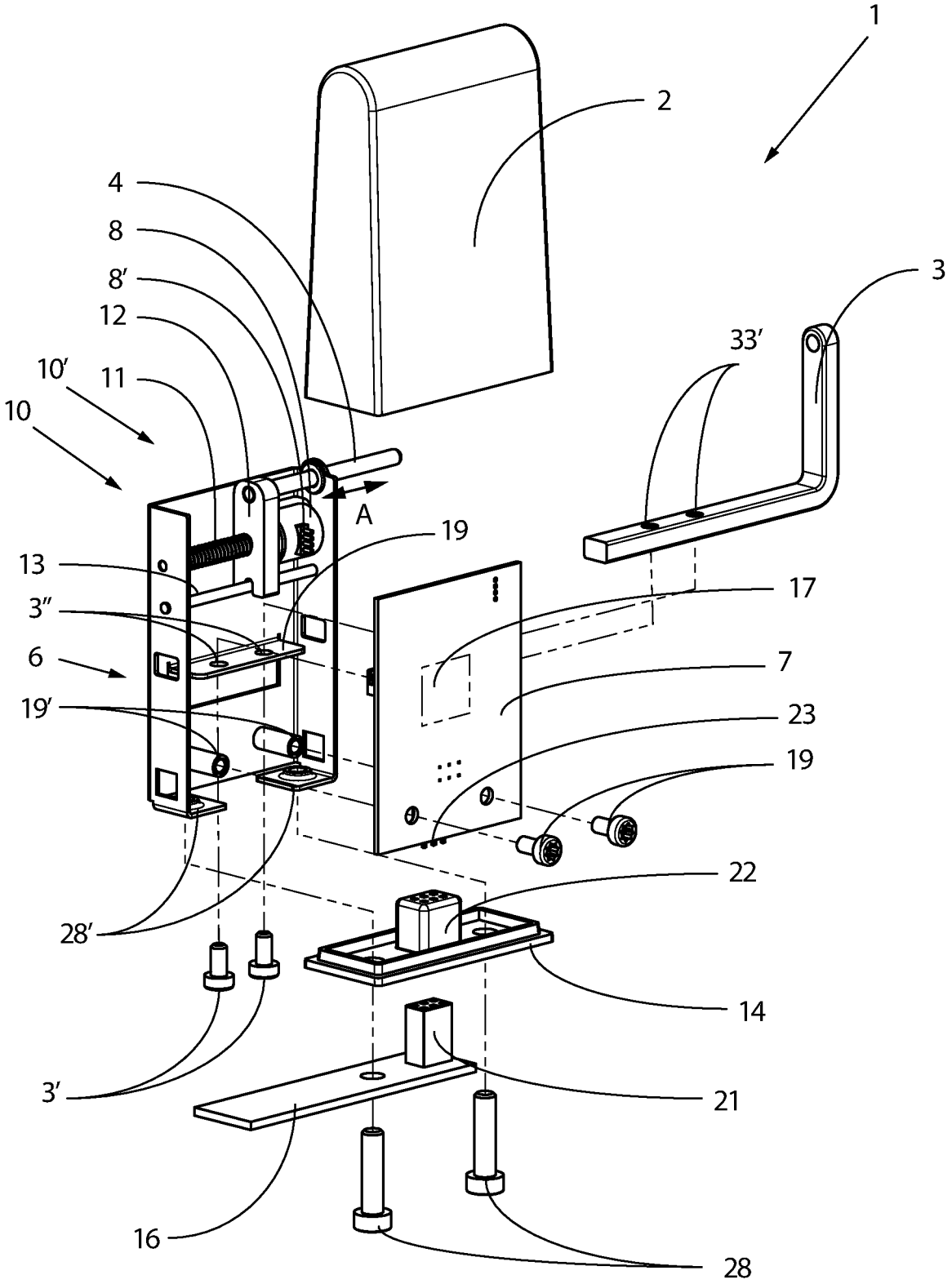
Figure 1C:
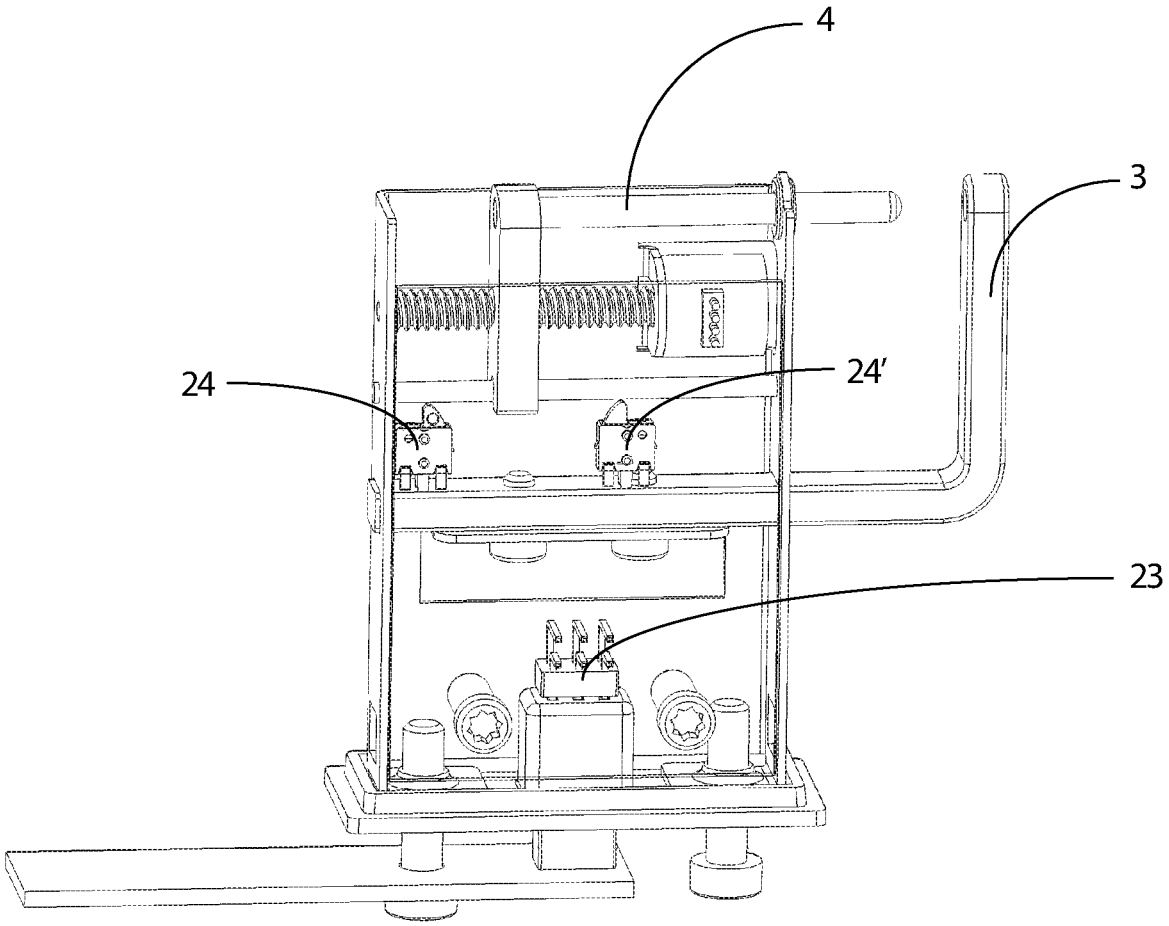

A first preferred embodiment (FIGS. 1A-C) according to the present invention relates to a spectacle frame securing device 1. It comprises display unit 1 for holding of a spectacle frame M. The display unit one comprises a housing to and a product holder 3 extending therefrom that is embodied as a preferably metal Bracket. The display unit one is mounted on a board 5, on which a number of such display units is arrangeable.

Within the housing 2, a frame 10 is arranged for providing of a firm mounting base for the product holder 3. The product holder 3 is mounted by means of bolts 3' to a set part 19 of the frame by means of openings 3", wherein the bolts 3' are screwed in openings 33' of the product holder that is hereto preferably provided with a thread.

Furthermore, a lock-in assembly 10' is provided. The lock-in assembly 10' comprises a lock-in pin for that functions as the lock-in member. The lock-in pin 4 is movable in the direction of the arrow a between an opened position and a closed position. To this end, a bar with a thread 11 is provided that is fastened to a server motor 8, which a server motor 8 can rotate the thread with which screw block 12, provided with an opening 12' with an inner thread, is driven.

The screw block 12 is connected with the pin 4. Furthermore, screw block 12 is coupled with the guiding bars 13 in a guiding or sliding manner for providing of a guiding to the screw block 12. With this, the screw block 12 is supported such that the pin for is drivable in the directions of the arrow when driven by the motor 8.

Furthermore, a PCB 7 is provided comprising a control unit 17 as well as to sensors that are embodied as switches 24, 24' for receiving bladder de screw block 12 is arranged in the position that corresponds to the opened or closed state of the pin 4. Alternatively, it is provided that the feedback information from the motor 8 provides information to the control unit relating to the position of the pin 4. Based on such sensor information, the motor or stepper motor may be calibrated in relation to the position relative to the sensor.

At the underside, the PCB 7 is provided with connector pins 23 that extend downwardly through respective openings in a plug contact housing 22 of the base 4 of the housing 2. With this, the connector pins 23 function as connector pins of a plug connection of the plug contact of the plug contact housing 22 for the purpose of a connector 21 of a PCB 16 that is arrangeable under the board 5. This PCB 16 serves as connection with a spectacle glasses securing control that is for instance arranged in the wall to which the board is fastened. This PCB 16 for example provides a solid design in case of a glass display board. Alternatively, wire connections are envisaged.

Figure 2A:
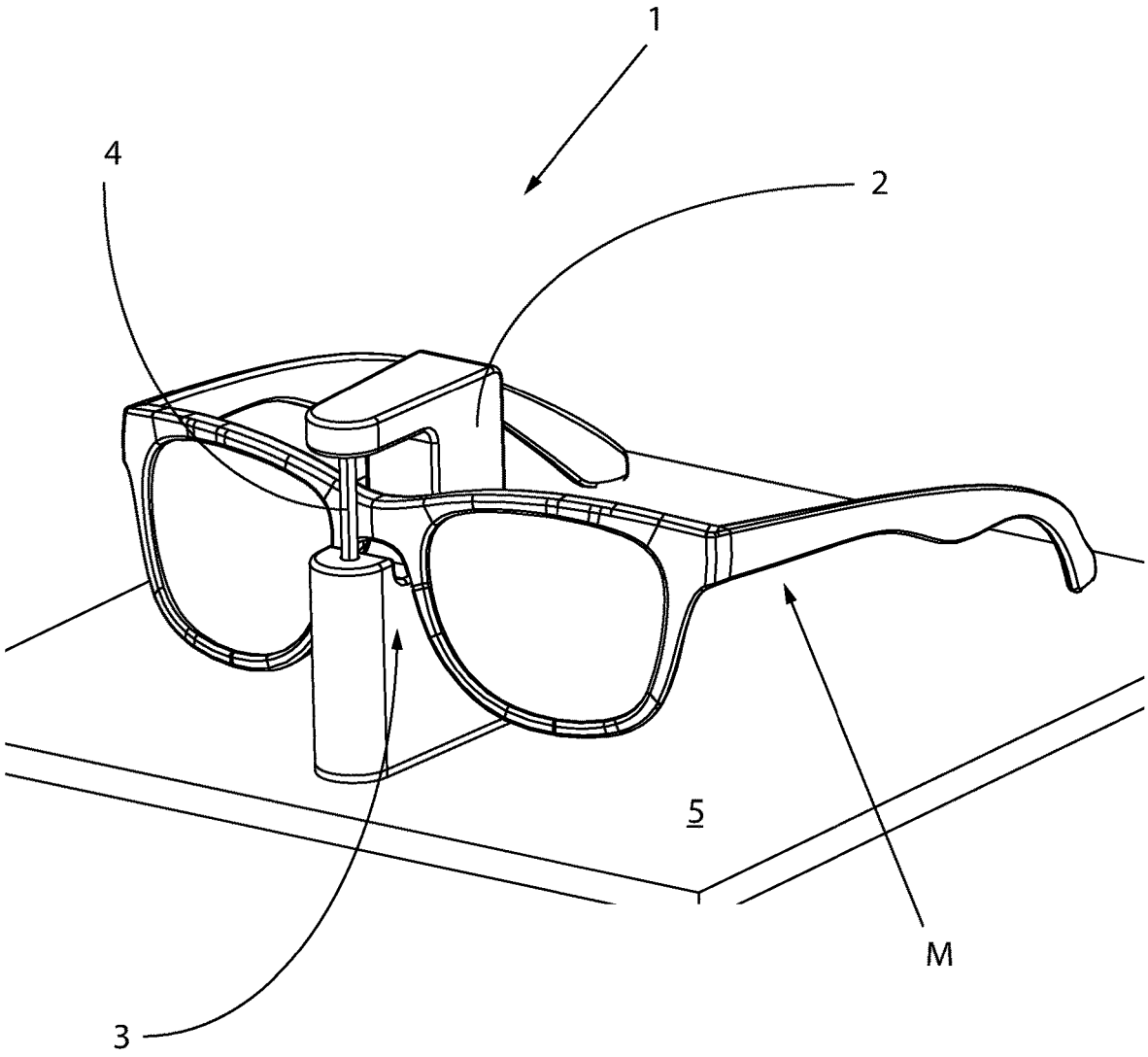
FIGS. 2A and 2B relates to two views of a second preferred embodiment according to the present invention.
Figure 2B:
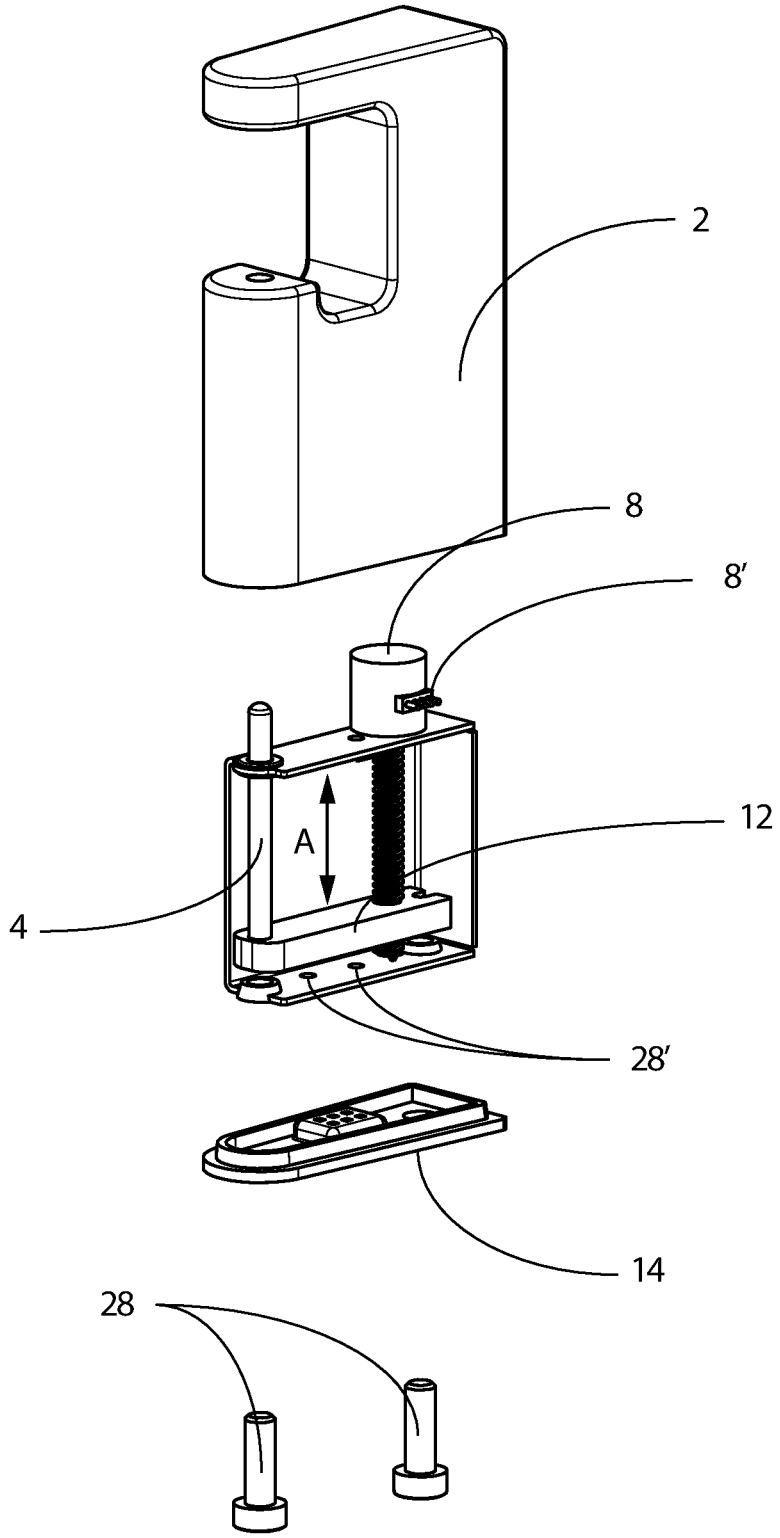

The variant according to FIGS. 2A and 2B relates to a variant in which product holder 3 is formed in the housing 2. With this, the pin that serve as lock-in member is particularly movable, at least in a direction perpendicular to the display board 5.

Figure 3A:
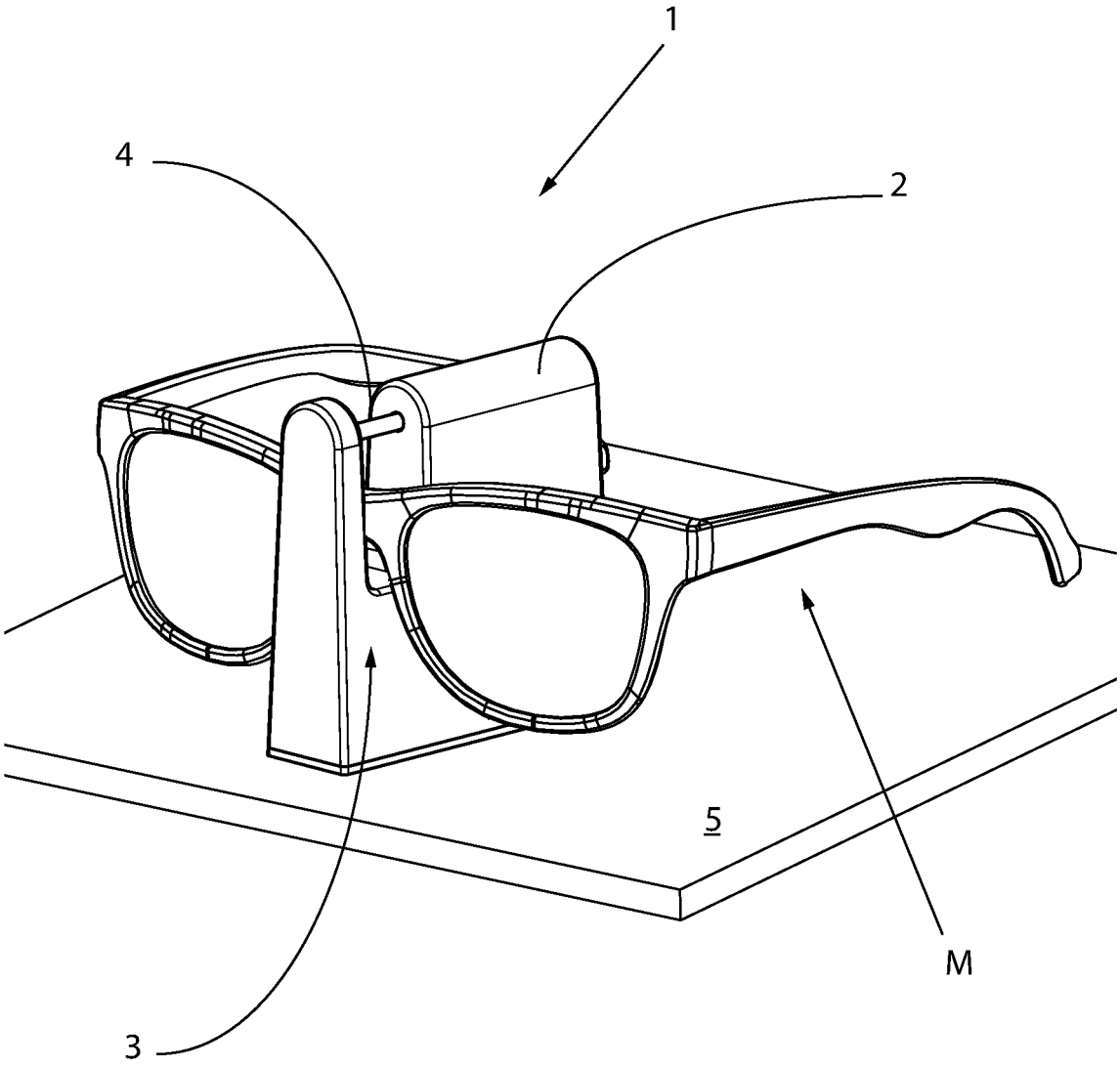
FIGS. 3A and 3B relates to two views of a third preferred embodiment according to the present invention.
Figure 3B:
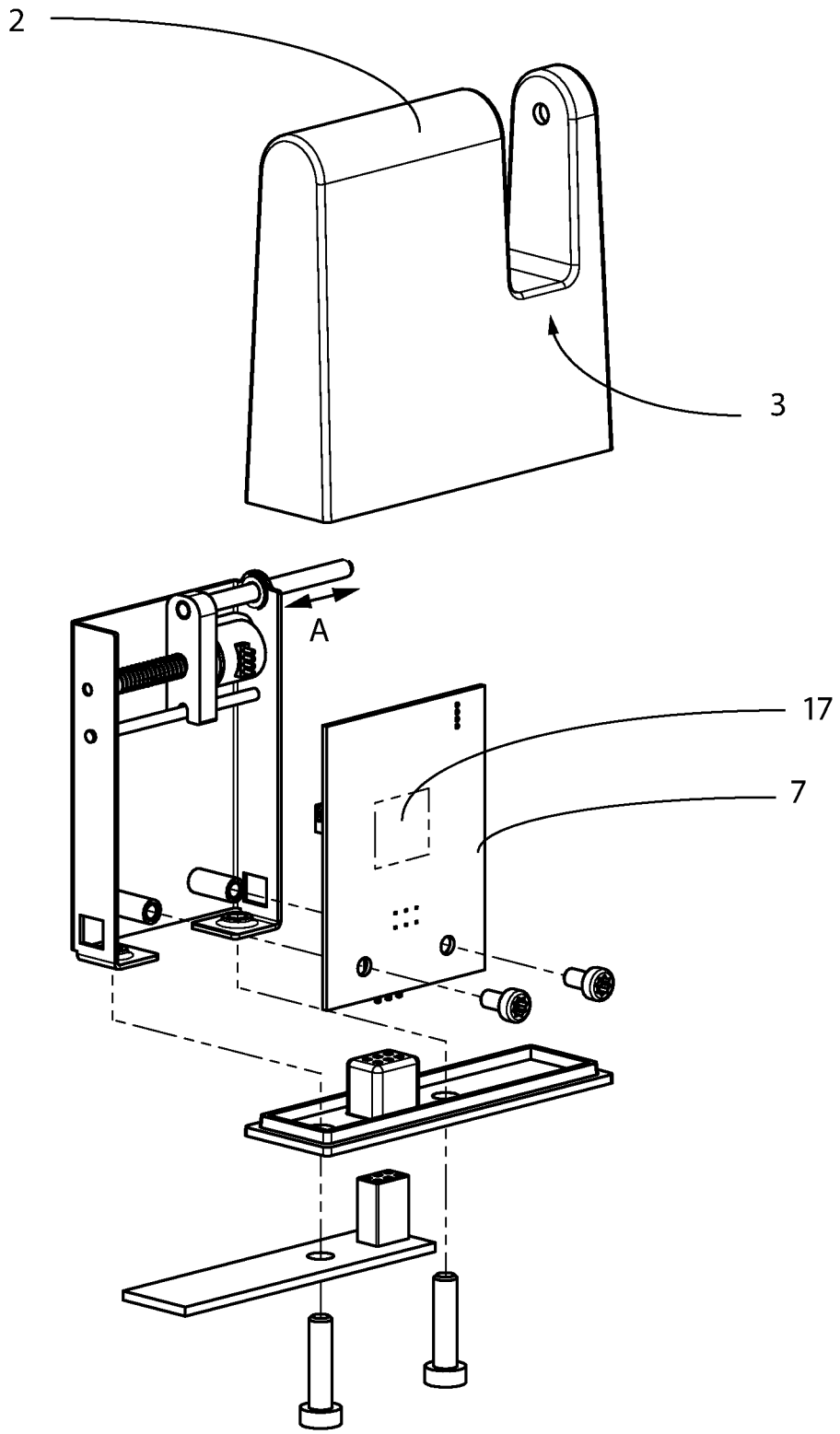

The variant according to FIGS. 3A and 3B relates to a variant in which the product holder 3 is shaped in the housing 2. With this, the pin serving as lock-in member, is horizontally movable, that is in a direction perpendicular to the display board 5. Similar parts as with the first preferred embodiment are also provided in this preferred embodiment.

Figure 4A:
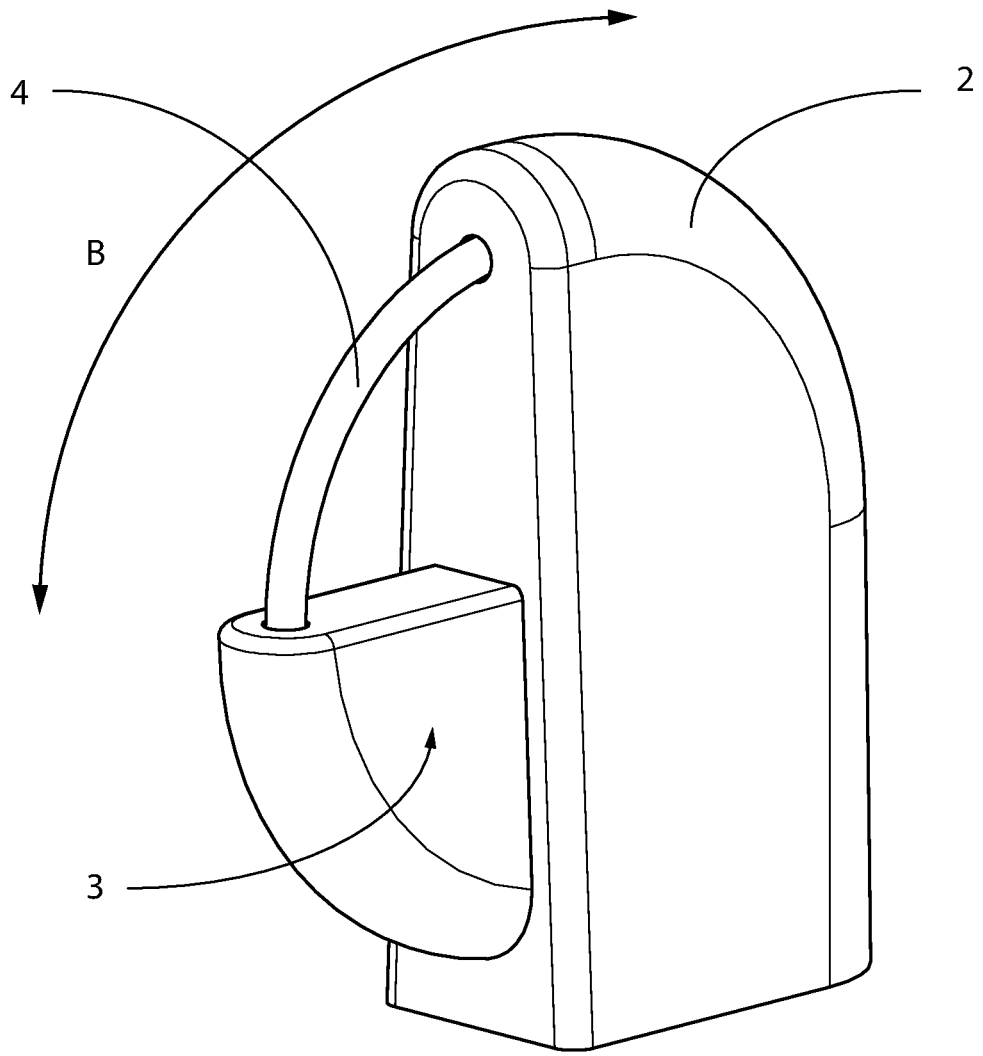
FIGS. 4A and 4B relates to two views of a fourth preferred embodiment according to the present invention.
Figure 4B:
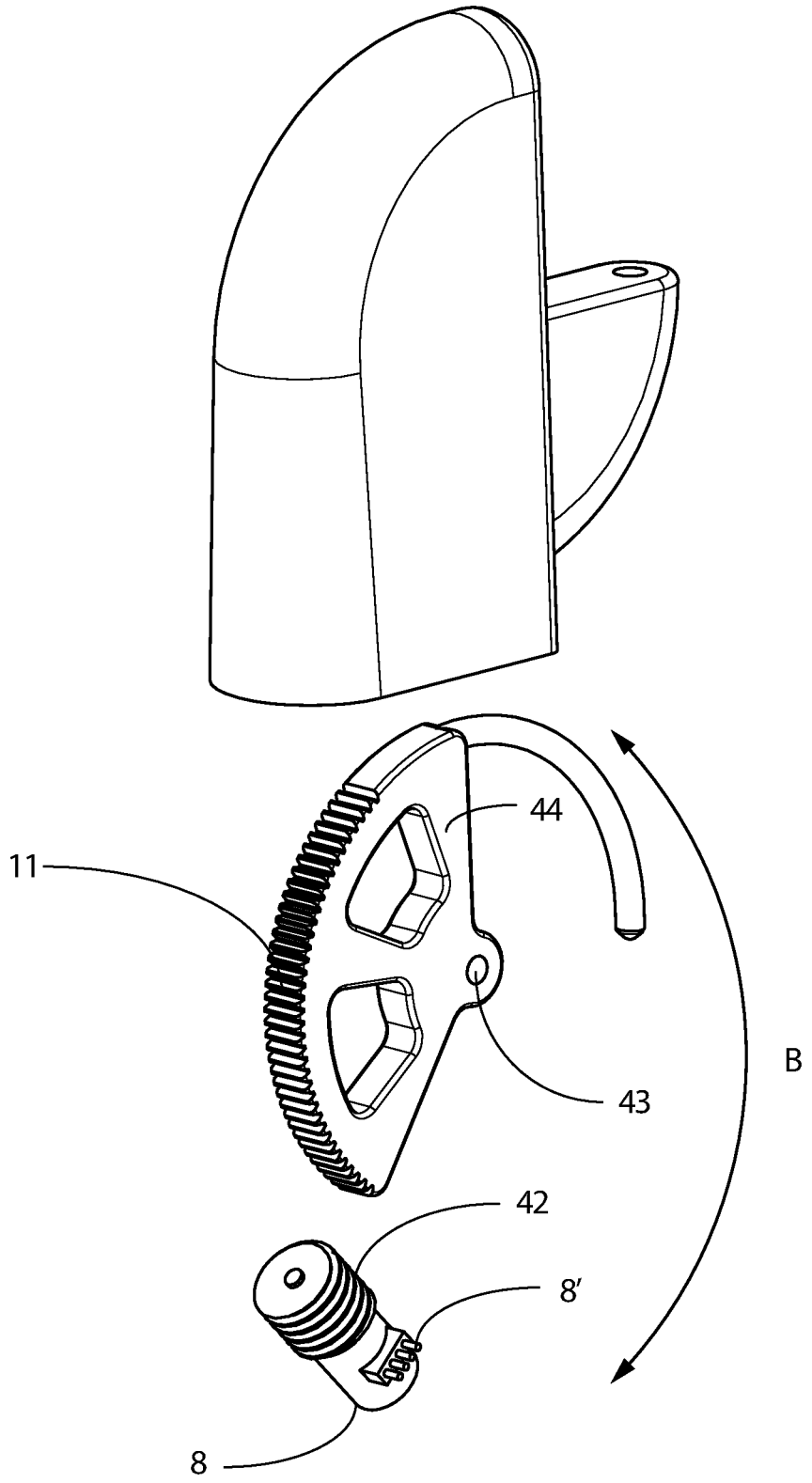

The variant according to FIGS. 4A and 4B relates to a variant in which the product holder 3 is formed as an element extending from a vertical font face of the housing. The lock-in member is perfectly formed as substantially a part of a ring. Herewith, the lock-in member for is provided with a sprocket segment 44 with a curved tooth rack 11 for driving with motor force thereof by means of a driving bar 42 that is provided with a thread. The sprocket segment 44 is rotatably arranged in the housing by means of an axle (not shown) passable through axle opening 43.

Figure 5A:
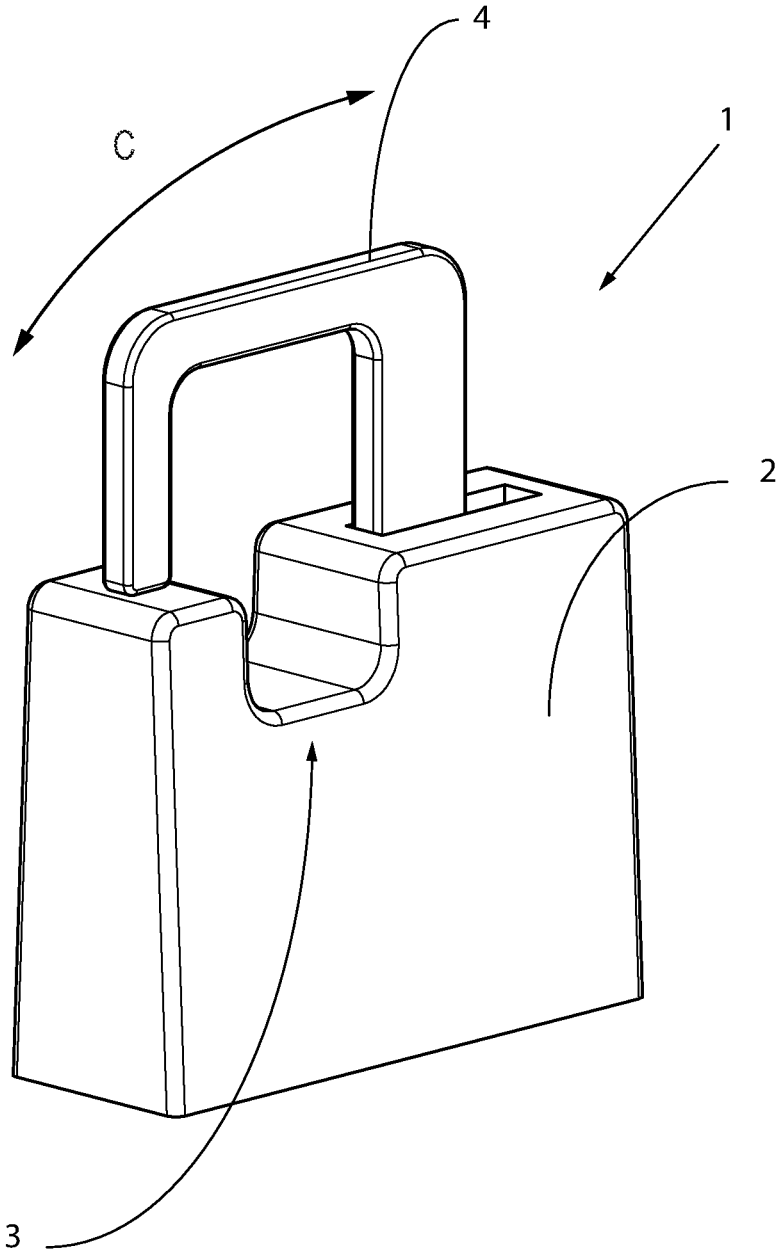
FIGS. 5A and 5B relates to two views of a fifth preferred embodiment according to the present invention.
Figure 5B:
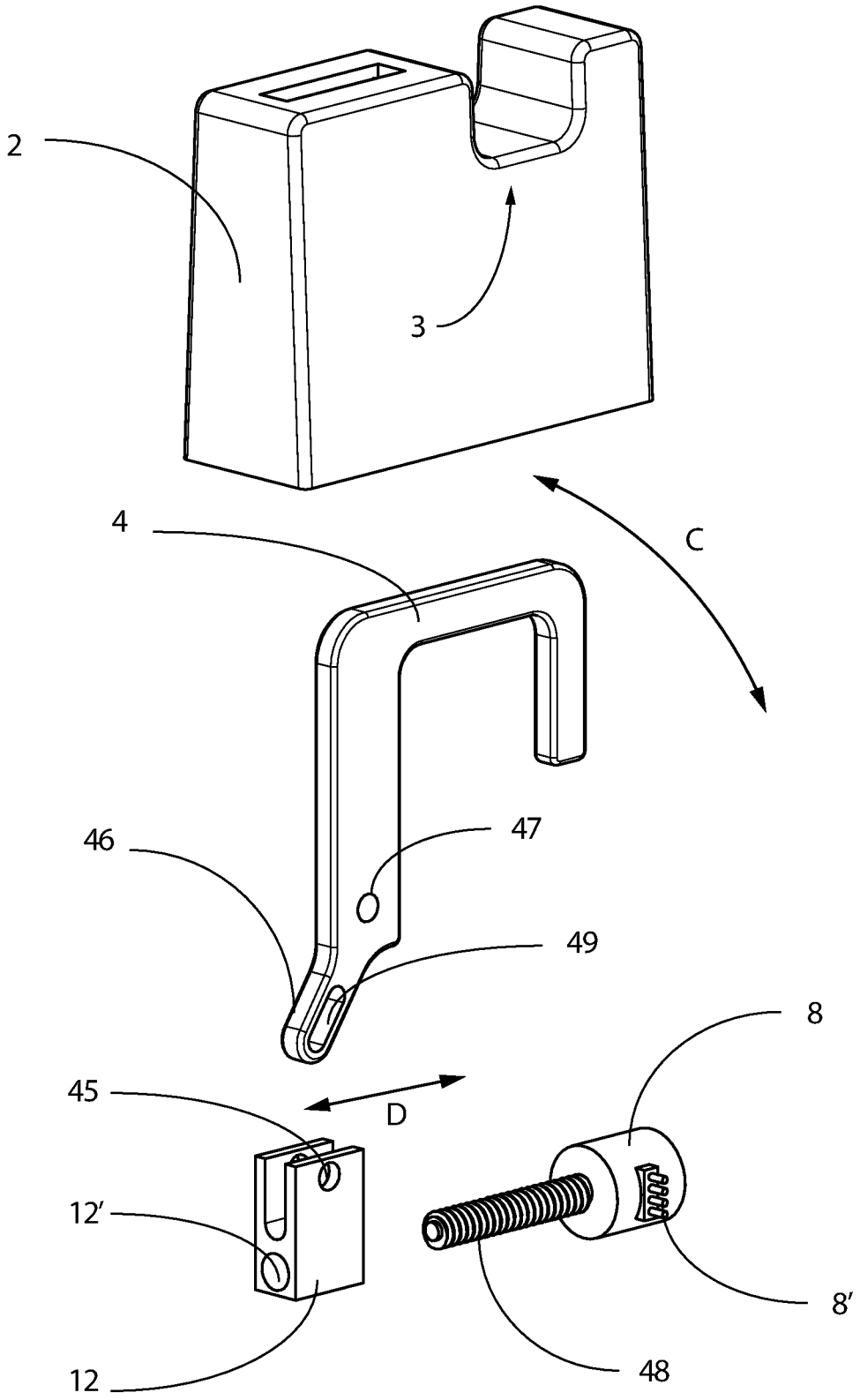

The variant according to FIGS. 5A and 5B relates to a variant wherein the product holder is formed in the housing 2. The lock-in member relates to a hook that is tiltably mounted in the housing around an axle through an axle opening 47. A screw block 12 has a screw opening 12' for driving thereof by a motor 8 with a spindle 48. An axle arranged in an axle opening 49 of lock-in member 4 is arrangeable in a through an opening 45 of the screw block for driving of the lock-in member 4.

Figure 6A:
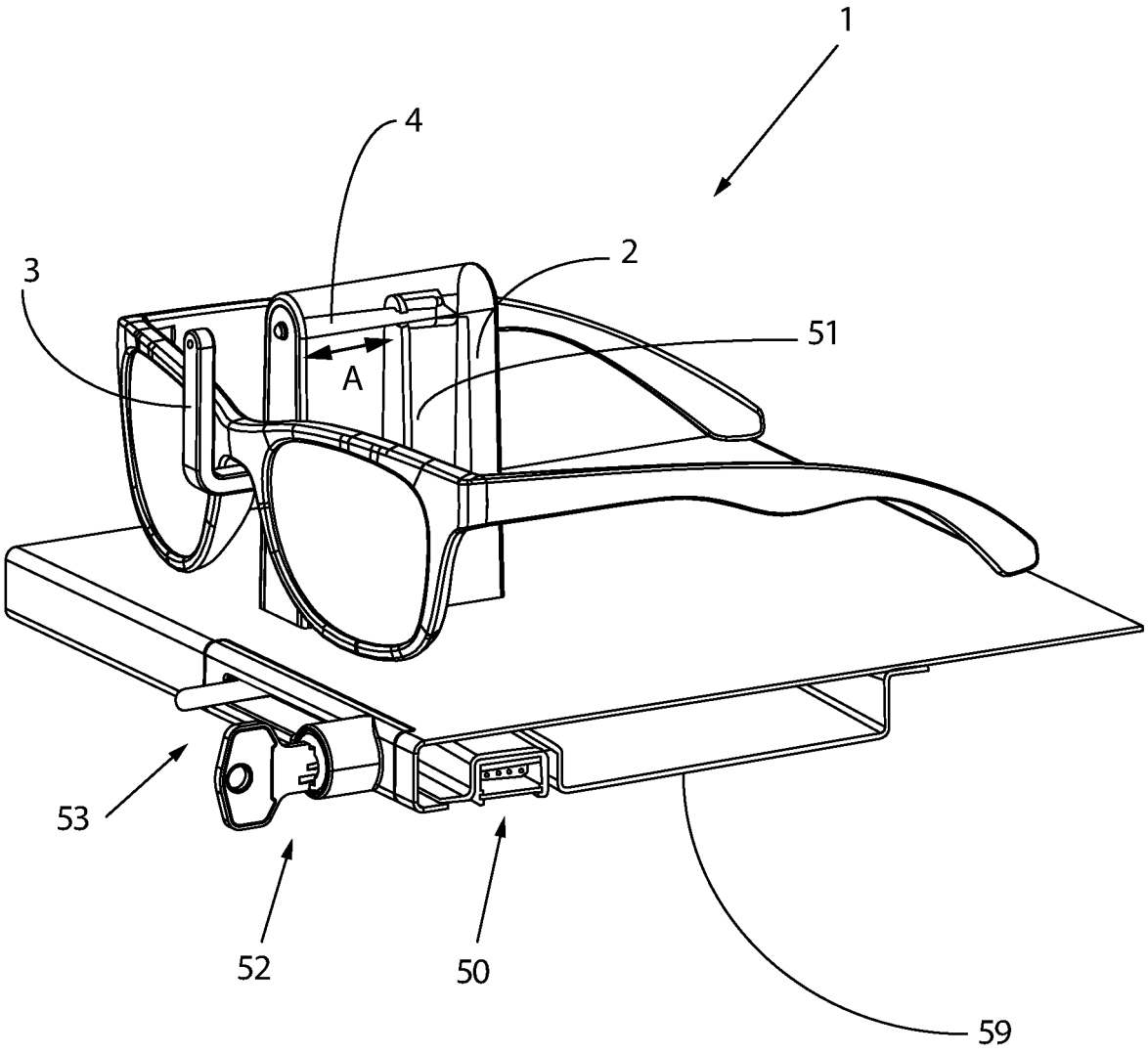
FIGS. 6A and 6B relates to two views of a 6 preferred embodiment according to the present invention.
Figure 6B:
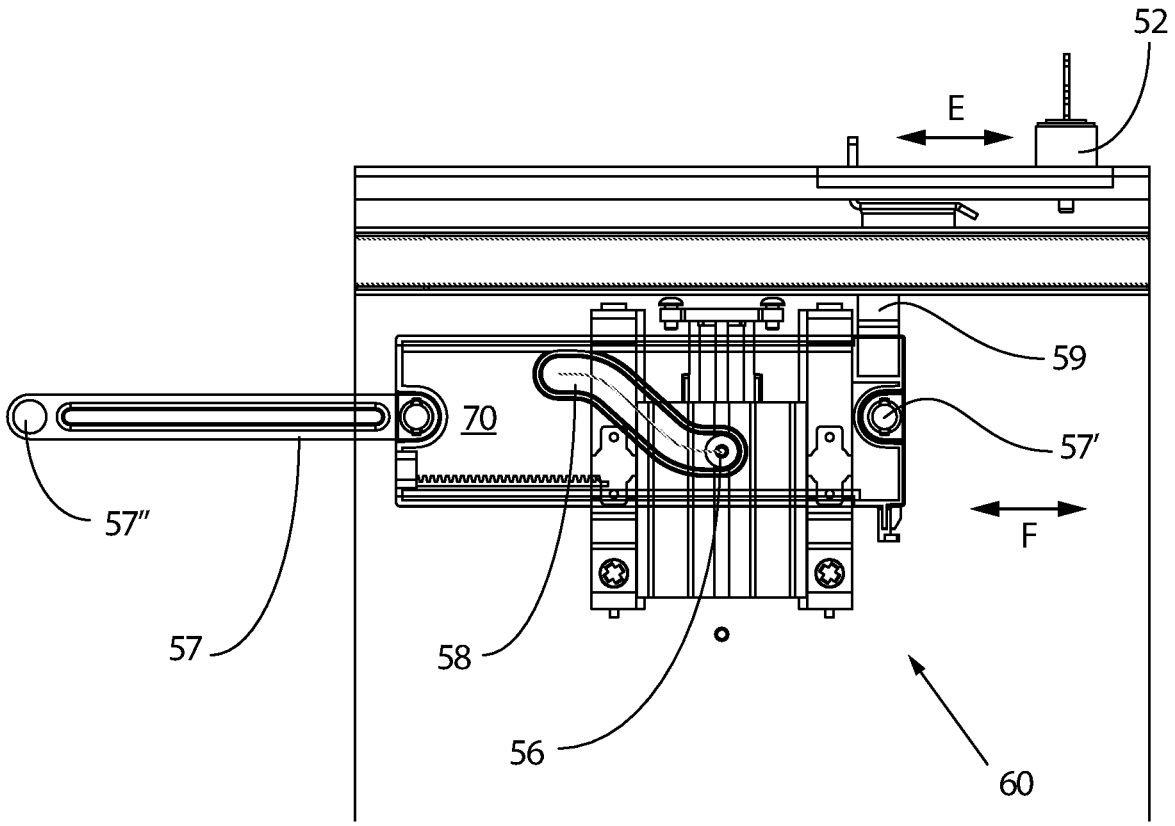

A further preferred embodiment according to the present invention is shown in FIGS. 6A and 6B. In this preferred embodiment, the shape of the housing and the product holder is substantially similar to that one of the first preferred embodiment. Also the lock-in member for moves in a similar manner. The driving of the lock-in member for is however realized by and in the housing horizontally moving: 51 that extends downward through the display board for driving by means of or driving assembly 60. The board driving assembly 60 provides a driving block 70 with a guiding control track 58. The driving block 70 is movably arranged for the purpose of movement in the direction of the arrow F. When driving block 70 is moved in the direction of the arrow 11, guide will 56 is burst through the guiding control track 58 in the direction perpendicular to that of arrow 11 with which the column 51 with the pin for is moved in the direction of the arrow A between the opened and closed position.

The lock 52 prevents movement in the closed condition and allows movement in the opened condition that is controllable by means of the key. The user moves the lock in the direction of the arrow E such that connecting rod 59 is also moved. The connecting rod 59 is fastened to the driving block 70. Several driving block 70 are mutually connectable by means of connecting rod 57 possible by means of eyes 57', 57". With this, the number of driving blocks is functional, by means of a movement of the lock, for the respective adjacently arranged display units (see FIGS. 7A and 7B).

Figure 7A:
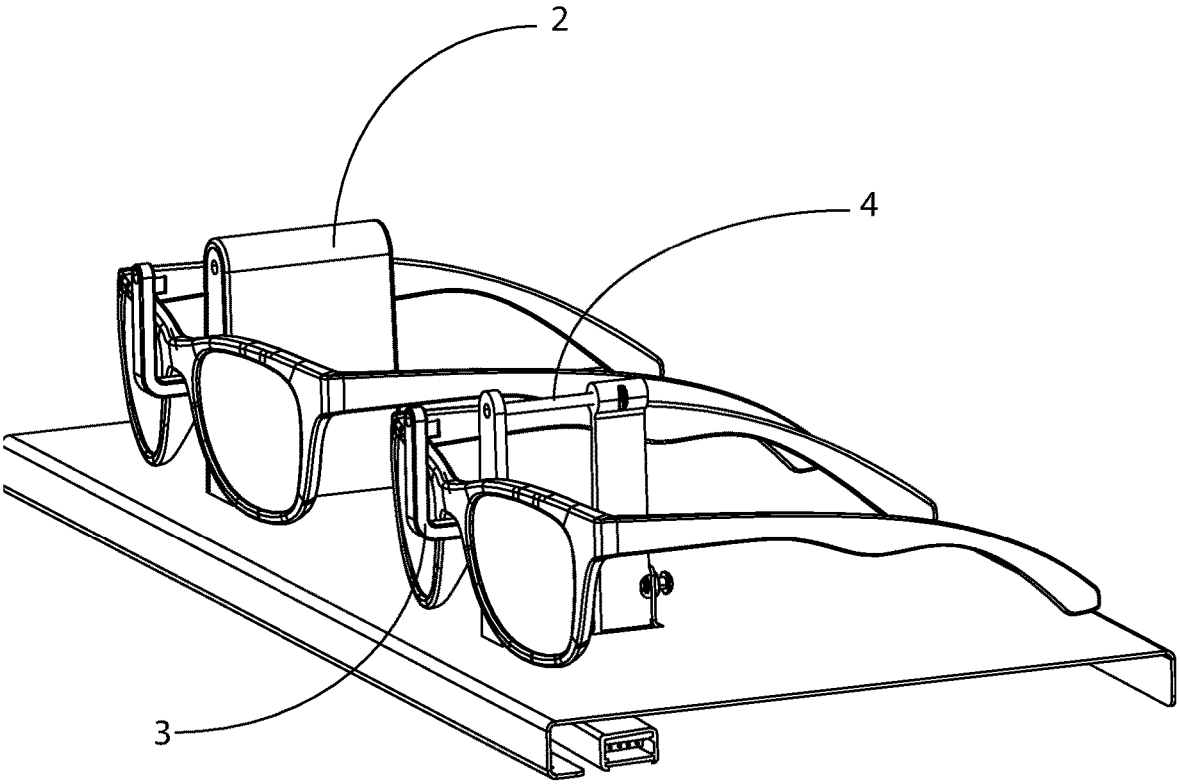
FIGS. 7A and 7B relates to two views of a seventh preferred embodiment according to the present invention.
Figure 7B:
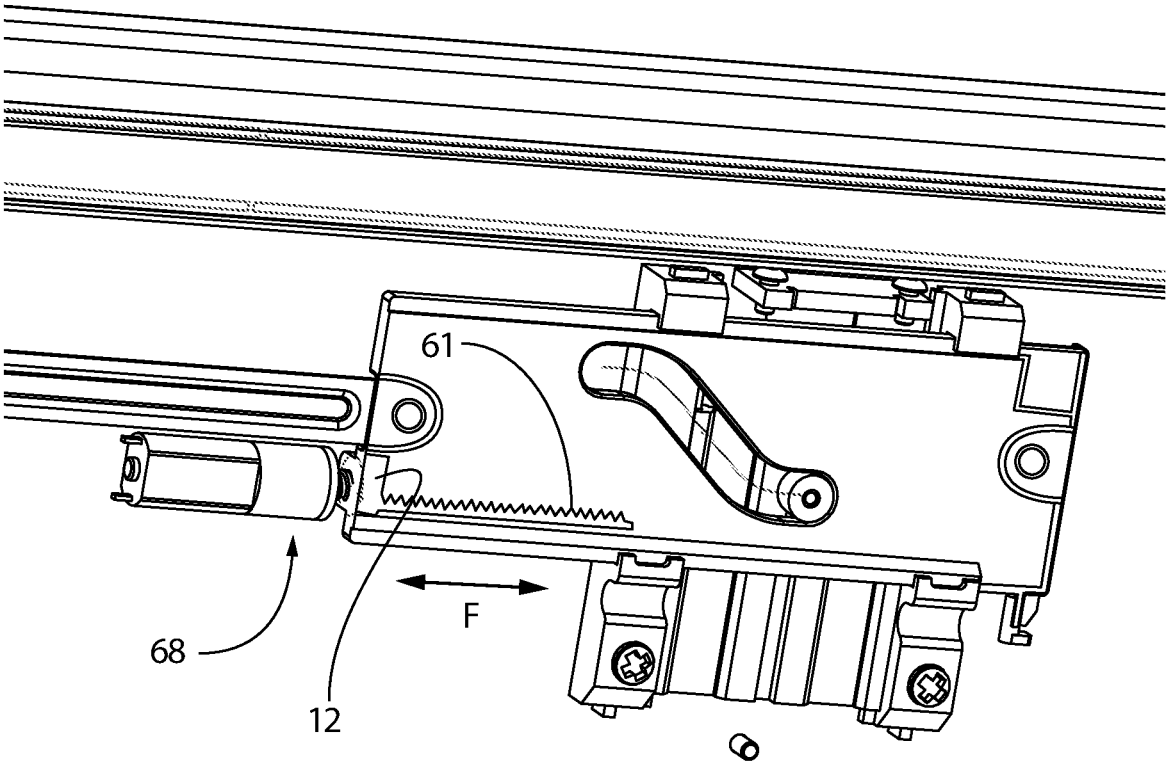

The variant of FIGS. 7A and 7B hands, instead of a lock driven manual drive, a motor driven drive of the drive block 70. The motor 68 is provided with a spindle 61 that is let through a screw opening of screw block self that is arranged at the driving block. With this, it is realized that the driving block is drivable by means of a motor, such as a DC motor or a server motor, that is controllable by means of a control unit, which control unit is controlled for driving of the motor by means of a spectacle frame securing control in case of the wish of opening and closing of the respective display units.

The present invention is described in the foregoing on the basis of preferred embodiments. Different aspects of different embodiments are expressly considered disclosed in combination with each other and in all combinations that on the basis of this document, when read by a skilled person of the area of skill, fall within the scope of the invention or are deemed to be read with the disclosure of this document. These preferred embodiments are not limitative for the scope of protection of this document. The rights sought are defined in the appended claims.

The invention claimed is:

1. A spectacle frame securing device for securely displaying a spectacle frame or glasses, relative to a display board with a display surface, during displaying thereof and releasing thereof for handling by a person, the device comprising:

at least one display unit comprising:

a frame or chassis arranged relative to the display surface, a product holder for holding a product during displaying of the spectacle frame or glasses, a lock-in assembly, the lock-in assembly comprising a lock-in member movable between an opened position and a closed position, for locking in of the product in the product holder when the lock-in member is in the closed position, transfer means for transferring a movement to the lock-in member from a drive means for moving the lock-in member between the opened position and the closed position, wherein each of the at least one display unit is separately arrangeable relative to the display surface of the display board, and comprising a control device, including a PCB including a processing unit and a memory comprising a program, for controlling the drive means.

2. The spectacle frame securing device according to claim 1, wherein the drive means comprises a drive motor for driving of the lock-in member between the opened position and the closed position.

3. The spectacle frame securing device according to claim 1, comprising a housing enclosing the frame and the lock-in assembly, wherein:

the housing encloses a part of the product holder or forms the product holder; and the housing comprises a base for arranging against the display surface.

4. The spectacle frame securing device according to claim 1, wherein the display unit is mounted to the display board by fastening means that extend between the display unit and a side of the display board opposite the display unit.

5. The spectacle frame securing device according to claim 1, wherein the PCB, the frame, the product holder and the lock-in assembly are arranged to the display surface of the display board as a unit or an assembly, and a contact means is provided for connecting with a counter contact from a side of the display board opposite the display surface of the display board.

6. The spectacle frame securing device according to claim 1, comprising a direct plug-in contact between the PCB and the drive means.

7. The spectacle frame securing device according to claim 1, wherein the product holder comprises a bracket that is fastened to the frame.

8. The spectacle frame securing device according to claim 1, wherein the lock-in member is a movable pin or bar that is substantially parallel to or substantially perpendicular to the display surface.

9. The spectacle frame securing device according to claim 1, wherein the transfer means comprises an axle with thread or a tooth rack.

10. The spectacle frame securing device according to claim 9, wherein the drive means drives the axle with thread, the axle with thread being arranged substantially parallel to the lock-in member, wherein the drive means comprises a propulsion member connected to a movable pin of the lock-in member and comprising a through opening provided with a thread for cooperating with the axle with thread and comprising a guiding pin or bar for guiding of the propulsion member at another side of the axle with thread relative to the lock-in member.

11. The spectacle frame securing device according to claim 1, comprising at least one sensor for receiving of a position of the lock-in member relative to the display surface, wherein the sensor is connected to the processing unit or arranged at the PCB.

12. The spectacle frame securing device according to claim 1, wherein the lock-in member is a movable around an axle of rotation, an arched pin or a bar that is driven by a curved tooth rack.

13. The spectacle frame securing device according to claim 1, wherein the lock-in member comprises a hingeable or tiltable hook element.

14. The spectacle frame securing device according to claim 1, comprising an electrical connection from the display unit for coupling with a spectacle frame securing control for provision of a control signal for the display unit for movement of the lock-in member between the opened position and the closed position from the spectacle frame securing control.

15. The spectacle frame securing device according to claim 14, wherein the electrical connection comprises a PCB, a cable, or a contactless connection.

16. The spectacle frame securing device according to claim 1, comprising connecting means for connecting the lock-in assembly with the drive means which includes a board drive assembly that is arranged, via an opening, on a side of the display board opposite the display surface of the display board.

17. The spectacle frame securing device according to claim 16, wherein the board drive assembly comprises a hand actuator secured by a lock or a drive means comprising a motor and a control unit comprising a processing unit and a memory comprising a program, for controlling the drive means.

18. The spectacle frame securing device according to claim 1, wherein the frame is enclosed in a housing.

19. A method for assembly of a display unit of a spectacle frame securing device according of claim 1, comprising steps of:

providing the frame and the drive means, providing the product holder, and assembling the frame, the drive means, and the product holder into an assembled display unit, wherein the frame and the drive means are provided as a prefabricated intermediate product.

20. The method according to claim 19, wherein the drive means in the prefabricated intermediate product is provided with a connector contact in a predetermined orientation for contacting a PCB contact, the method comprising the steps of positioning of the frame relative to the PCB and making the contact therewith between the connector contact of the motor and the PCB contact.

21. A spectacle frame securing device for securely displaying a spectacle frame or glasses, relative to a display board with a display surface, during displaying thereof and releasing thereof for handling by a person, the device comprising:

at least one display unit comprising:

a frame or chassis arranged relative to the display surface, a product holder for holding a product during displaying of the spectacle frame or glasses, a lock-in assembly, the lock-in assembly comprising a lock-in member movable between an opened position and a closed position, for locking in of the product in the product holder when the lock-in member is in the closed position, transfer means for transferring a movement to the lock-in member from a drive means for moving the lock-in member between the opened position and the closed position, wherein each of the at least one display unit is separately arrangeable relative to the display surface of the display board, connecting means for connecting the lock-in assembly with the drive means which includes a board drive assembly that is arranged, via an opening, on a side of the display board opposite the display surface of the display board, and wherein the board drive assembly comprises a guiding control track for providing of a transverse transmission of a driving movement by hand force or motor force to the connecting means.

22. The spectacle frame securing device according to claim 21, comprising passage means for drivingly passing of a lighting module arranged on a side of the display board opposite the display surface.

* * * * *